US010610875B2

(12) United States Patent
Gackstetter

(10) Patent No.: US 10,610,875 B2
(45) Date of Patent: Apr. 7, 2020

(54) DE-ICING APPARATUS

(71) Applicant: Cameron E. Gackstetter, Fairbanks, AK (US)

(72) Inventor: Cameron E. Gackstetter, Fairbanks, AK (US)

( * ) Notice: Subject to any disclaimer, the term of this patent is extended or adjusted under 35 U.S.C. 154(b) by 139 days.

(21) Appl. No.: 15/714,843

(22) Filed: Sep. 25, 2017

(65) Prior Publication Data

US 2018/0008992 A1 Jan. 11, 2018

Related U.S. Application Data

(62) Division of application No. 14/326,339, filed on Jul. 8, 2014, now Pat. No. 9,802,210.

(51) Int. Cl.

| | |
|---|---|
| ***B05B 1/24*** | (2006.01) |
| ***B05B 13/06*** | (2006.01) |
| *B05B 14/00* | (2018.01) |
| *B05B 15/60* | (2018.01) |

(52) U.S. Cl.

CPC ..... *B05B 1/24* (2013.01); *B05B 13/069* (2013.01); *B05B 13/0627* (2013.01); *B05B 14/00* (2018.02); *B05B 15/60* (2018.02)

(58) Field of Classification Search

None

See application file for complete search history.

(56) References Cited

U.S. PATENT DOCUMENTS

| | | | | |
|---|---|---|---|---|
| 3,809,317 | A | 5/1974 | Bender | |
| 7,479,192 | B2 | 1/2009 | Otterson | |
| 7,686,023 | B2 * | 3/2010 | McMillen | B08B 3/026 134/104.2 |
| 2010/0150640 | A1 * | 6/2010 | Tetteh | A47L 11/201 401/268 |
| 2015/0275449 | A1 * | 10/2015 | Sanchez | E01H 5/102 432/88 |
| 2016/0008824 | A1 | 1/2016 | Gackstetter | |

FOREIGN PATENT DOCUMENTS

| | | | |
|---|---|---|---|
| WO | WO2015/016783 | A1 | 2/2015 |
| WO | WO-2015016783 | A1 * | 2/2015 |

* cited by examiner

*Primary Examiner* — Cristi J Tate-Sims

(74) *Attorney, Agent, or Firm* — Lee & Hayes, P.C.

(57) ABSTRACT

Illustrative processes remove ice buildup in containers or other locations by melting the ice using a de-ice component. Waste fluid may be removed using a vacuum component. The de-ice component causes discharge of pressurized fluid to melt ice. The de-ice component may include a base with guide features configured to engage an opening of the container. The de-ice component may direct a spray of the pressurized fluid into the container to melt the ice. The de-ice component may include a pressure regulator valve to selectively regulate a resulting force of the fluid sprayed into the container, which may enable a user to avoid damaging internal components located within the container. The vacuum component may cause the pressurized fluid to flow through a high pressure nozzle to create a vacuum effect at a suction inlet, which can extract waste fluid and/or other debris from the container.

20 Claims, 13 Drawing Sheets

SECTION A-A

SECTION A-A

SECTION A-A

DETAIL B

DETAIL C

DE-ICING APPARATUS

CROSS-REFERENCE TO RELATED APPLICATION

This application is a division of, and claims priority to, co-pending commonly-owned, U.S. patent application Ser. No. 14/326,339 filed Jul. 8, 2014, and entitled "DE-ICING APPARATUS," which is herein incorporated by reference in its entirety.

BACKGROUND

In environments that experience prolonged freezing temperatures (below 32 degrees Fahrenheit), buildup of ice can be problematic. For example, some containers may become filled with ice over time, which may require removal for a desired use of the container. In some instances, ice can removed using additives, like salt, which lowers the freezing point of water and causes ice to melt in some conditions. However, use of additives has some drawbacks. Additives usually take a considerable amount of time to melt ice and leave a sometimes undesirable waste product (e.g., the salt), which may cause damage by excessive buildup and/or by accelerating corrosion of some materials like metal.

Ice can also be melted by applying a heating device, such as a heated coil to the ice. For example, heated coils may be placed in a container that is filled with ice or the heated coils may be integrally formed with the container and activated to heat the container, and thus prevent buildup of ice or to melt existing ice. Often, electricity is applied to the coils to create the heat, which may then melt ice that is in the container. Some coils may use transfer heat from hot water to the ice and operate as a radiator. However, use of a heating device also has drawbacks. Applying heat can take a considerable amount of time depending on the way the heat is applied. When heat is generated from electricity, use of heat may expose a user to electrical shock. Heating devices can be expensive, especially when they are dedicated to a single location, such as when they are integrated in a container since each container would then have a dedicated heating device. Finally, use of heating devices may be impractical in many situations, such as when a heating device cannot be easily installed in a specific space.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

This disclosure is directed to a de-ice apparatus that can be used to remove ice buildup in containers and/or in other locations by melting/thawing the ice through use of a de-ice component and removing resulting waste water through use of a vacuum component. The de-ice component uses pressurized water, which is heated and pressurized by a pressure washer, to melt ice. The de-ice component may include a base with guide features configured to engage an opening of a container that includes the ice. The de-ice component may include a plurality of hoses and/or nozzles to direct a spray of the pressurized water into the container to melt the ice. The de-ice component may include a pressure regulator valve to regulate a force of water sprayed into the container, which may enable a user to avoid damaging internal components located within the container.

The de-icing apparatus may also include a vacuum component that can remove waste water from the container. The vacuum component may cause the pressurized water, also from the pressure washer, to flow through a high pressure nozzle to create a vacuum effect at a suction inlet, which can remove waste water, fluid, and/or other debris from the container. By using the same source of pressurized water in both the de-ice component and the vacuum component, the de-icing apparatus is compact, portable, and minimizes parts.

The apparatuses and techniques described herein may be implemented in a number of ways. Example implementations are provided below with reference to the following figures.

Figure 1:
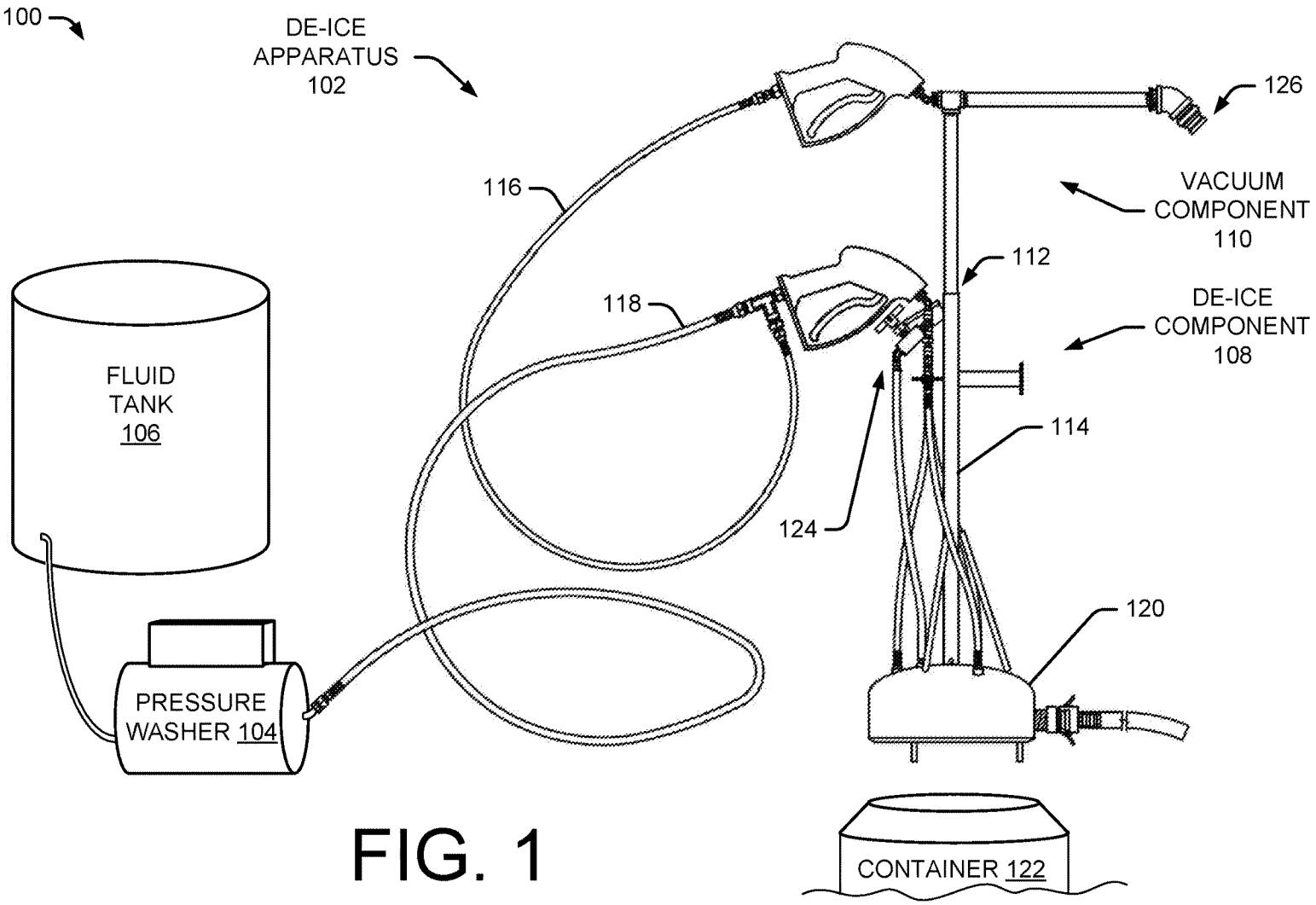
FIG. 1 is a schematic diagram of an illustrative de-ice assembly that includes a de-ice apparatus including a de-ice component and a vacuum component.

FIG. 1 is a schematic diagram of an illustrative de-ice assembly 100 that includes a de-ice apparatus 102. The de-ice apparatus 102 may receive pressurized water from a pressure washer 104. The pressure washer 104 may receive water, or other fluid, from a fluid container 106. Although the discussion herein often refers to use of "water," it should be understood that any type of fluid may be used. In addition, the fluid may include additives, which may lower a freezing temperature of the fluid, cause friction when sprayed against an object, and/or have other useful attributes. The de-ice apparatus 102, the pressure washer 104, and the fluid container 106 may be configured for transport in a defined space for easy transport by trailer, by plane, or by other vehicles. The pressure washer 104 may heat the water and pressurize the water. The pressurized water may then be made available to the de-ice apparatus 102 as discussed below.

Figure 2:
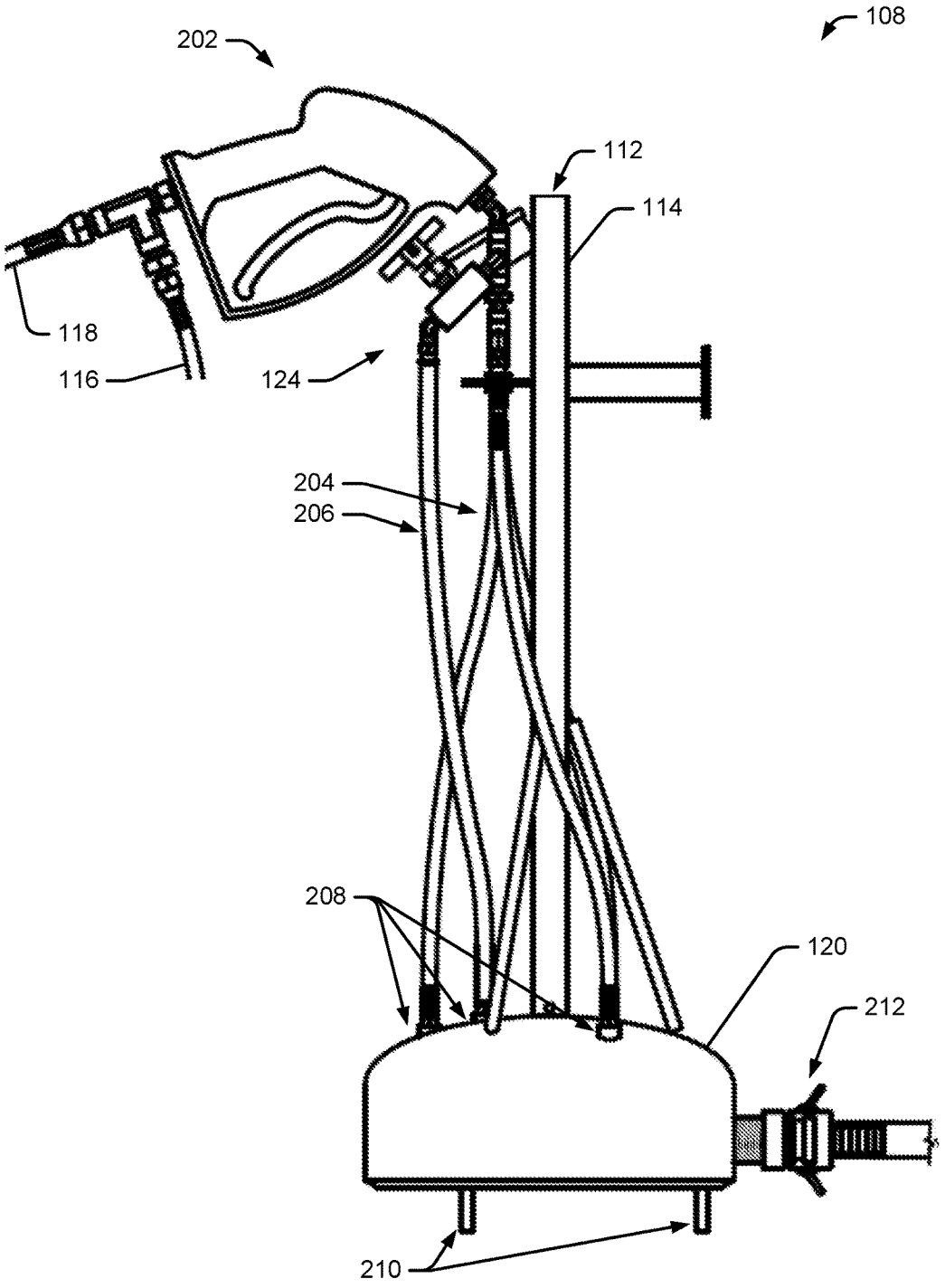
FIG. 2 is a side elevation view of the de-ice component shown in FIG. 1.
Figure 9:
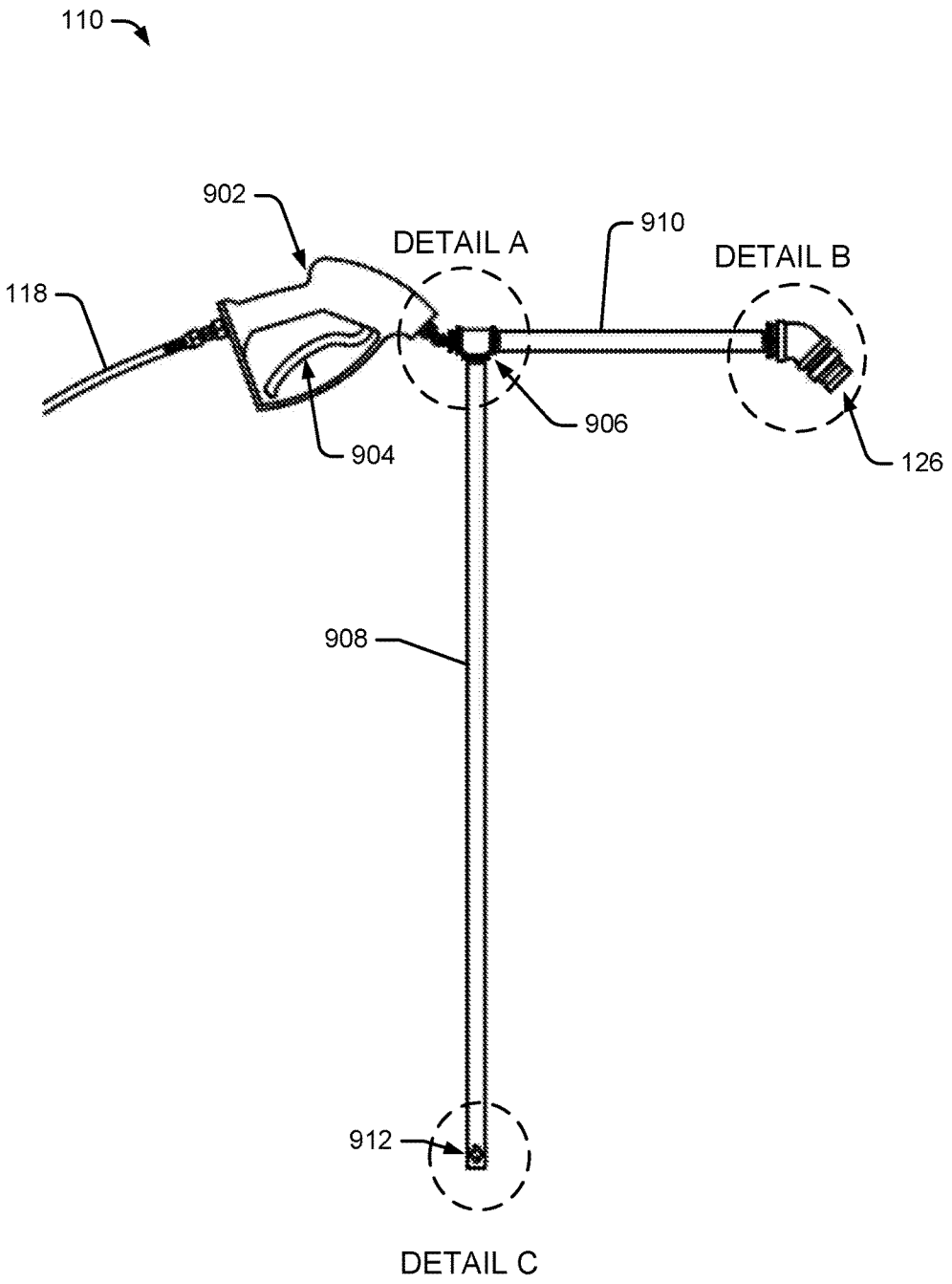
FIG. 9 is a side elevation view of the vacuum component shown in FIG. 1.

The de-ice apparatus 102 includes a de-ice component 108 and a vacuum component 110. As shown in FIGS. 2 and 9, the de-ice component 108 (shown in FIG. 2) may be at least partially separated from the vacuum component 110 (shown in FIG. 9) during use. For example, the vacuum component 110 may be removed from a holder 112 on a support structure 114 of the de-ice component, but may remain tethered to the de-ice component 108 by a hose 116.

The de-ice component 108 may receive the pressurized water from the pressure washer 104 via a hose 118. The de-ice component 108 may enable controlled discharge of the pressurized water from a base 120 through use of one or more nozzles. The base 120 may be configured to align with and/or engage an opening of a container 122 that contains ice to be removed. The de-ice component 108 may also include a pressure regulator valve 124 to regulate a resulting force of water discharged through the base 120. Additional details about the de-ice component 108 are provided below with reference to FIGS. 2-8.

The vacuum component 110 may receive the pressurized water from the pressure washer 104, via the hoses 116 and 118. The vacuum component 110 may cause the pressurized water to flow through a high pressure nozzle to create a vacuum effect at a suction inlet, which can remove waste water, waste fluid, and/or other debris from the container 122 or from other locations. The vacuum component 110 may discharge waste water, waste fluid, and/or debris from an outlet nozzle 126. In some embodiments, the outlet nozzle 126 may be attached to a hose that directs waste water to a discharge container, to the fluid tank (for recycled use), or to another location. Additional details about the vacuum component 110 are provided below with reference to FIGS. 9-12.

FIG. 2 is a side elevation view of the de-ice component 108 shown in FIG. 1. The de-ice component 108 may include the support stand 114 and the base 120, as discussed above. The support stand 114 is configured to couple to, either directly or indirectly, a trigger mechanism 202 that allows or prevents flow of the pressurized water supplied by the pressure washer 104 via the hose 118. The trigger mechanism 202 may be implemented as virtually any type of valve that allows a user to open the valve and close the valve. The valve may be opened to intermediate states between fully opened and fully closed. In some embodiments, the valve may maintain a state (e.g., open, partially open, closed, etc.) without interaction by a user. In various embodiments, a user may pull a trigger, lever, etc. to selectively open the valve and maintain the open state. From the trigger mechanism 202, the pressurized water flows to the pressure regulator valve 124, which is described in more detail in FIGS. 6 and 7. In some embodiments, the pressure regulator valve 124 may be located between the pressure washer 104 and the trigger mechanism 202 such that the pressure regulator valve 124 provides water with the regulated pressure to the trigger mechanism 202.

From the pressure regulator valve 124, the pressurized water flows through one or more regulated hoses 204 and a discharge hose 206. The regulated hoses 204 may transport water that includes an adjusted pressurization resulting from the pressure regulator valve 124, and thus water having a same or lower pressure than the pressurized water that enters the pressure regulator valve 124. The discharge hose 206 may transport water that passes through a relief valve in the pressure regulator valve 124, and thus is removed from entering the regulated hoses 204 to achieve the adjusted pressurization. The regulated hoses 204 transport the water to nozzles 208 coupled to the base 120. The discharge hose 206 may transport excess water through the base 120. In some embodiments, the discharge hose 206 may transport water to a separate nozzle coupled to the base 120. The water from the nozzles 208 provides a directed spray of heated water outward from the base 120.

The base 120 may be formed in a cap or bowl shape such that the base includes a concave profile and opening when viewed from a side opposite the support stand 114. The nozzles 208, which are coupled to the regulated hoses 204 and/or the discharge hose 206, are coupled to the base 120, and extend through apertures in the base. Thus the water from the nozzles 208 is directed to spray from the base 120 in a direction opposite and away from a side of the base that includes the support stand 114.

The base 120 may include guide features 210 that are configured to engage an opening of the container 122 that includes the ice or to otherwise elevate the base from a surface, such as by acting as support legs. An overflow outlet 212 may extend from the base 120 and include an aperture to allow water to exit the base. However, a large portion of the water may exit from an underside of the base 120 from a gap between the base 120 and the container 122 or other location.

Figure 3:
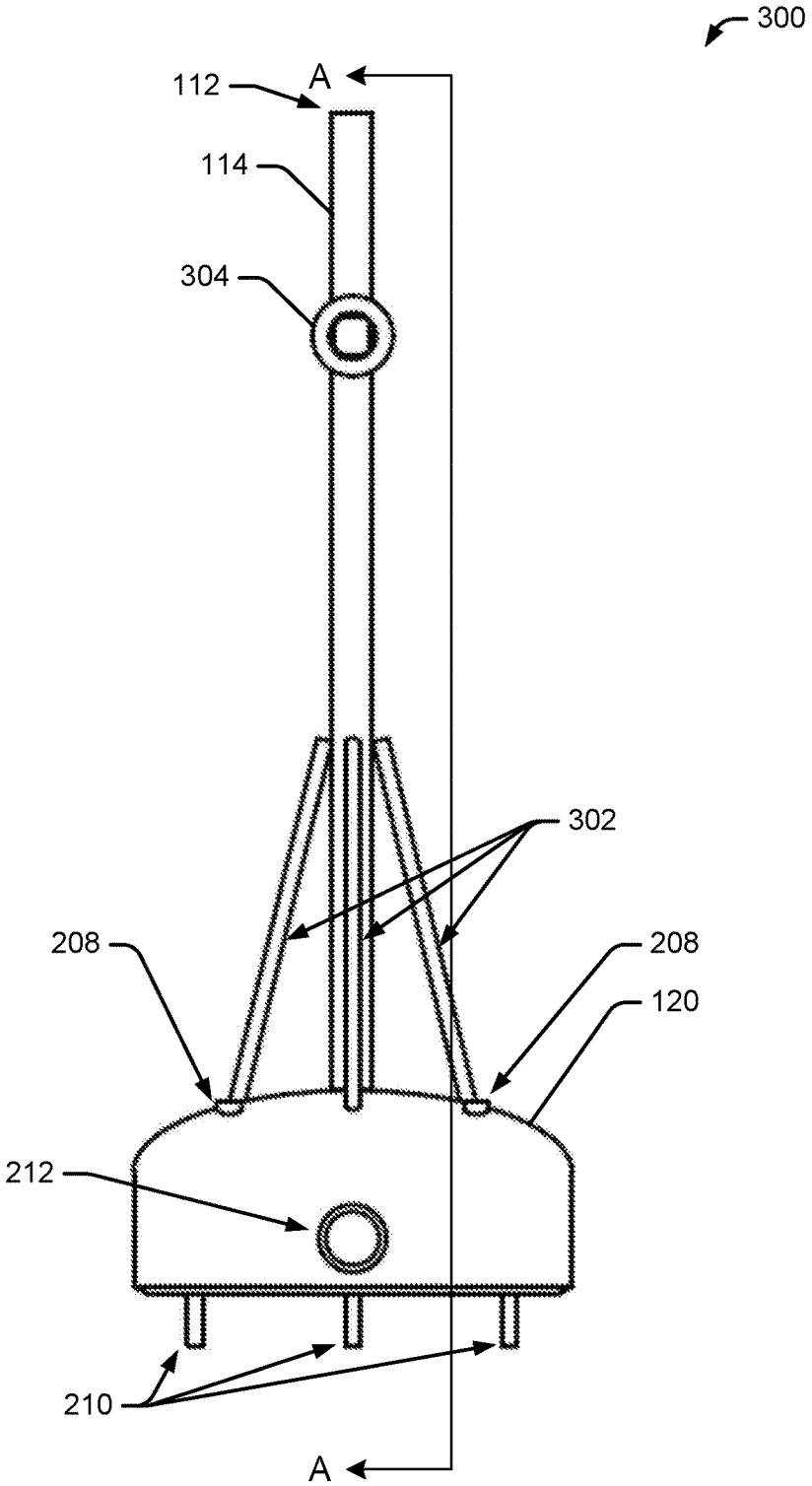
FIG. 3 is a side elevation view of a support structure assembly of the de-ice component.

FIG. 3 is a side elevation view of a support structure assembly 300 that includes the support structure 114 and base 120 of the de-ice component 108. The support structure 114 may be coupled to the base 120 in different ways (e.g., threaded, welded, integrally formed, etc.). Stabilizers 302 may further couple the support shaft to the base 120 to increase a rigidity of a connection between the support structure 114 and the base 120.

The support structure 114 may be a hollow steel member that has an inner diameter or cross sectional area that is configured to act as the holder 112 and receive a corresponding tube that is part of the vacuum component 110. Thus, the support structure 114 may act as a holster for the vacuum component 110. However, other attachment mechanisms may be used. The support structure 114 may include a handle 304 that allows a user to conveniently transport the de-ice apparatus 102. The handle 304 may also be used to turn or rotate the de-ice apparatus about an axis parallel to the support shaft 114 during a de-icing operation to allow water discharging outward from the nozzles 208 to be directed to different areas, such as different areas within the container 122.

Figure 4A:
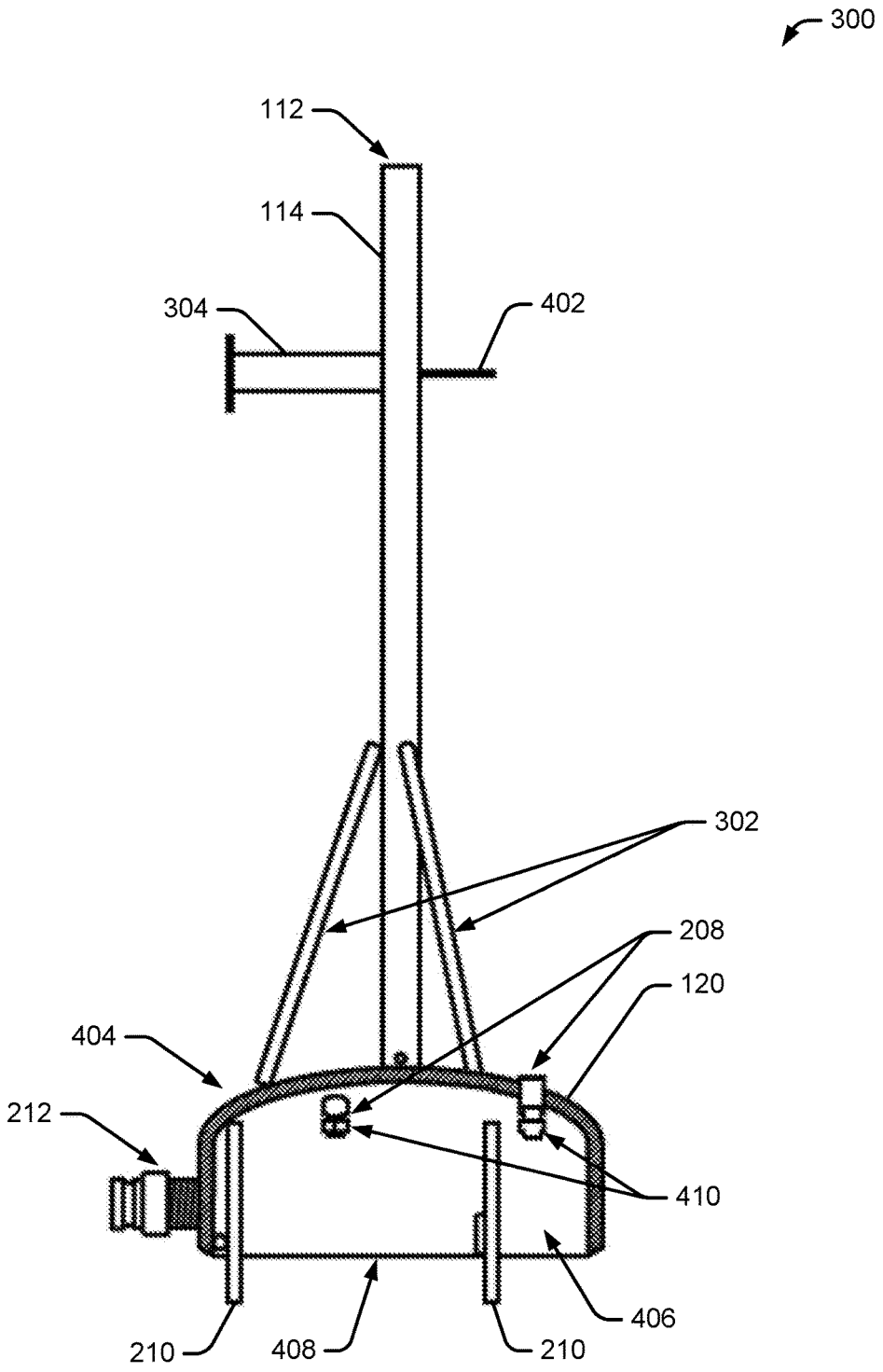
FIG. 4A is a cross-sectional view of the support structure assembly shown in FIG. 3.

FIG. 4A is a cross-sectional view of Section A-A of the support structure assembly 300 shown in FIG. 3. As described above, the support structure 114 includes the handle 304 that projects outward from the support structure 114. The handle 304 may be coupled to the support structure 114 in one or more different ways (e.g., threads, welded, integrally formed, etc.). The support structure 114 may include one or more coupling features 402 that are configured to couple to the pressure regulator valve 124, the trigger mechanism 202, and/or other parts of the de-ice apparatus. The coupling features 402 may include threaded rods that project outward from the support structure 114. The coupling features 402 may be coupled to the support structure 114 in one or more different ways (e.g., threads, welded, integrally formed, etc.).

As shown in the cross-sectional view of Section A-A of the support structure assembly 300, the base 120 includes a concave shape 404 and defines a cavity 406. The cavity 406 includes an orifice 408 that allows water from the nozzles 208 to exit the base 120. The nozzles 208 may include diffusers 410 that at least partially diffuse the water as it exits a nozzle. In some embodiments, the diffusers 410 may be adjustable to adjust the amount of diffusing of the water, such as to create greater disbursement of the water or to reduce disbursement of the water, such as to form a condensed flow or stream of water. The diffusers 410 may be individually adjustable or adjustable in groups when adjustment features (e.g., screws, etc.) are linked together to allow adjustment of multiple diffusers at a same time through a single operation.

Figure 4B:
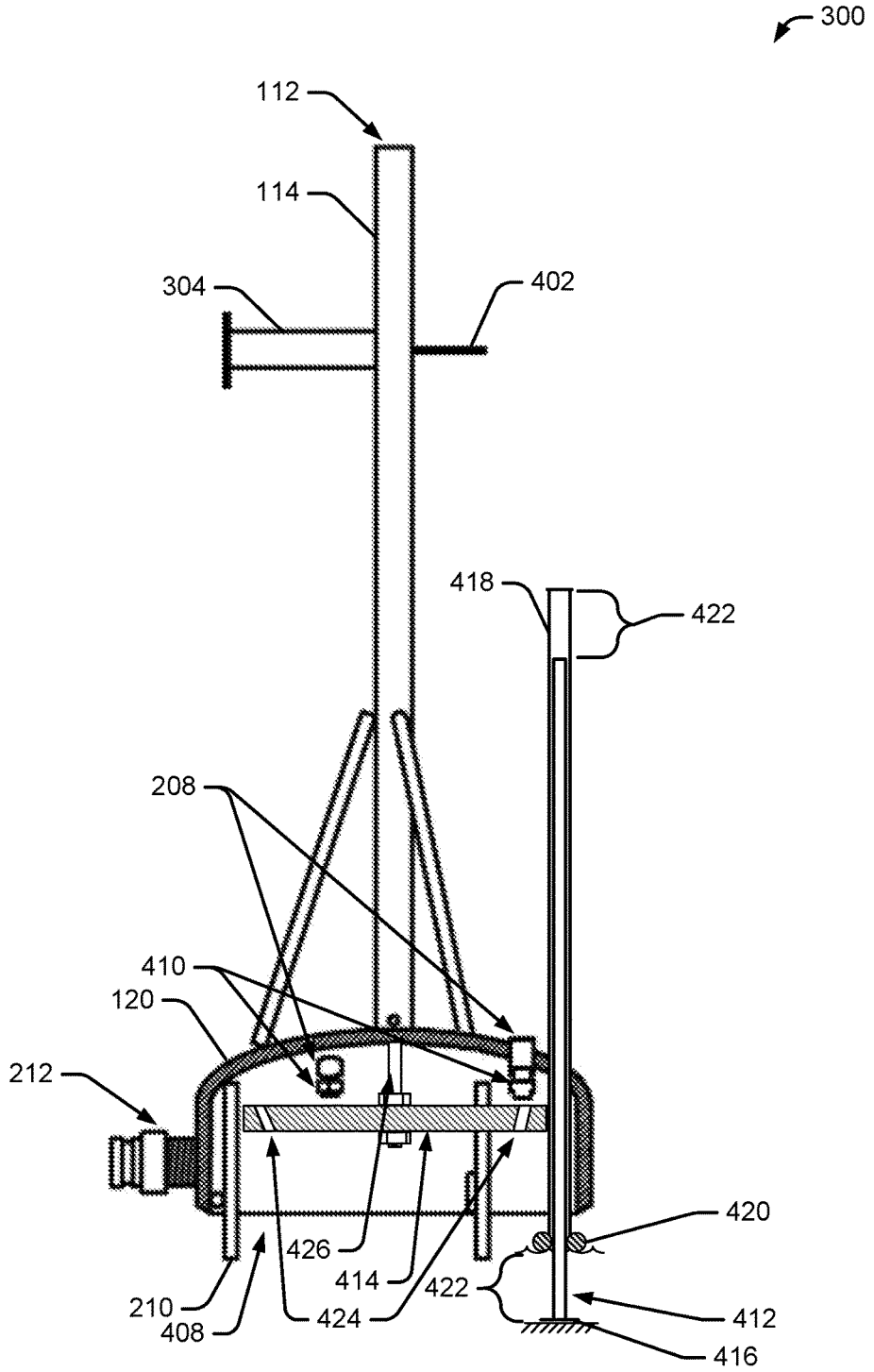
FIG. 4B is a cross-sectional view of the support structure assembly shown in FIG. 3, and including a depth gauge and a rotary diffuser.

FIG. 4B is a cross-sectional view of the support structure assembly 300 shown in FIG. 3, and including a depth gauge 412 and/or a rotary diffuser 414. The depth gauge may be used to measure or monitor a distance between the base 120 and a level of ice that is melted using the techniques discussed herein. As the ice underneath the base 120 melts, the depth gauge 412 may continually move downward due to gravity such that a first end 416 of the depth gauge contacts ice in the container 122. A user may monitor this movement to determine a depth of waste water in the container 122. As the depth of the waste water becomes greater, the user may decide to adjust the pressure to increase the pressure of water through the regulated hoses 204 via the pressure regulator valve 124 and/or adjust the diffusers 410 to create a less disbursed spray so that the water exiting the nozzles 208 can penetrate deeper through the waste water.

In some embodiments, the depth gauge 412 may include color codes or other indicators that correspond to color codes or indicators used by a pressure gauge included in the pressure regulator valve 124. This may guide a user in adjusting the pressure using the pressure regulator valve 124. In various embodiments, the pressure may be automatically adjusted based on movement of the depth gauge 412, thus the pressure regulator valve 124 may be mechanically or electrically coupled to the depth gauge.

In various embodiments, the depth gauge 412 may include a float gauge 418 that enables measurement of a distance to a surface of the water in the container 122. For example, a floating object 420 may be coupled to an end of the float gauge and may float on top of water in the container 122. In some embodiments, the float gauge 418 may be separate from the depth gauge 412 (e.g., use a different aperture in the base, etc.). Together, the float gauge 418 and the depth gauge 412 may provide a measurement 422 of a depth of fluid in the container 122, which may be used to indicate a change in pressure (via the pressure regulator valve 124) or a change in disbursement (via the diffusers 410) of the water. However, use of the depth gauge 412 may be sufficient without the float gauge 418 in some configurations.

The rotary diffuser 414 may diffuse water discharged from the nozzles 208 such that the water is dispersed over a greater surface area while maintaining a consolidated stream (e.g., not necessarily diffused, but continually redirected via the rotary diffuser). As the pressurized water sprays out of the nozzles, the water may contact angled features 424, such as apertures or fins in the rotary diffuser 414, causing the rotary diffuser 414 to rotate about an attachment feature 426 and about a longitudinal axis of the support structure 114. The fins may be similar to turbine fins. As the rotary diffuser 414 rotates, water discharged from the nozzles 208 may be redirected at different directions based on the apertures/fins, and thereby be directed to spray different locations under the base 120. However, by manually rotating the de-ice apparatus about an axis parallel to the support shaft 114, using the handle 304, during a de-icing operation may cause distribution of the spray of water without use of the rotary diffuser 414.

Figure 4C:
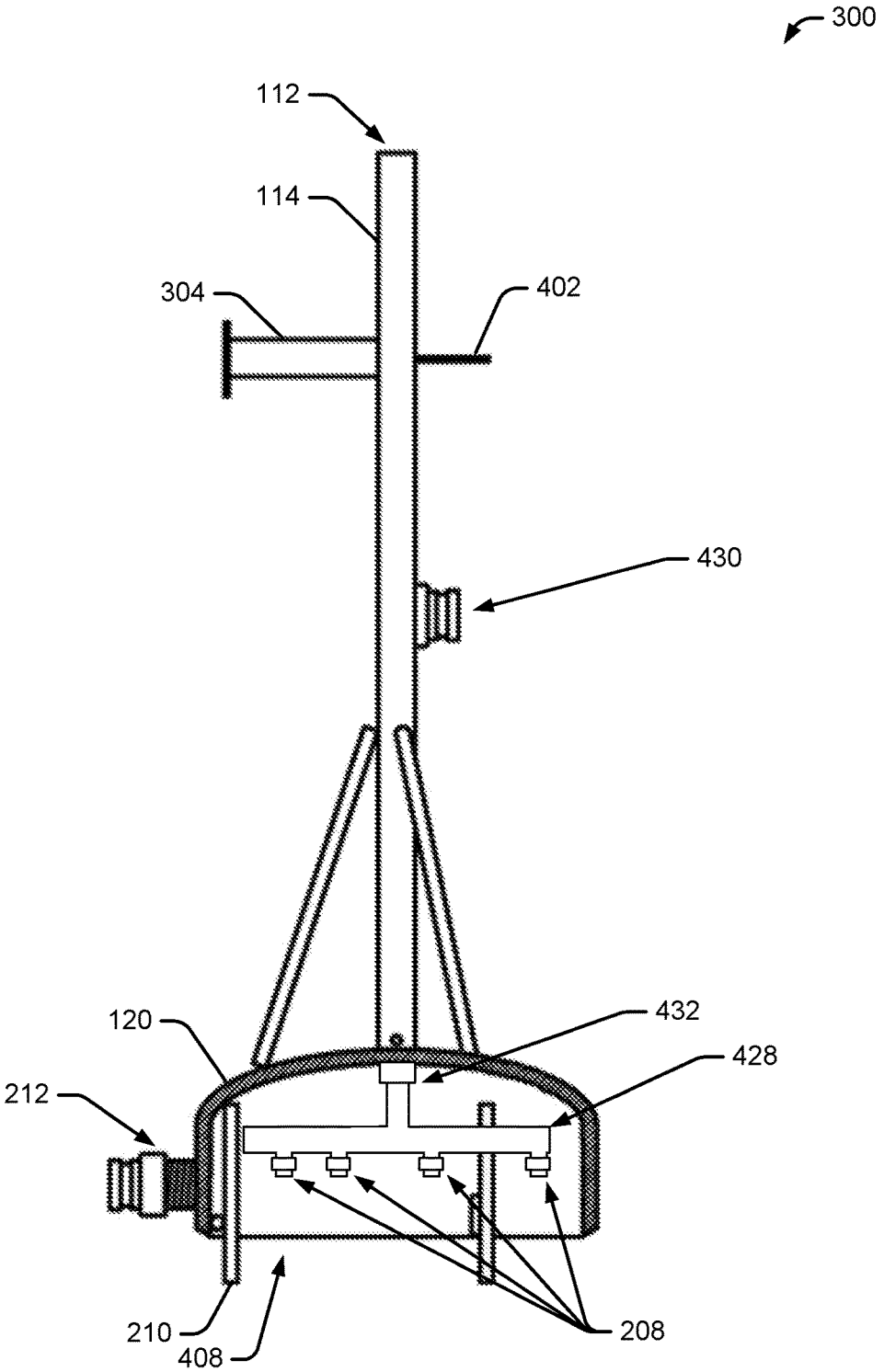
FIG. 4C is a cross-sectional view of the support structure assembly shown in FIG. 3, and including a rotary boom.

FIG. 4C is a cross-sectional view of the support structure assembly 300 shown in FIG. 3, and including a rotary boom 428. The rotary boom 428 may be in fluid communication with a nozzle 430 that receives the water from the regulated hose(s) 204. The rotary boom 428 may include a rotation mechanism 432 that allows or causes rotation of the rotary boom 428 about a longitudinal axis of the support structure 114. The rotation mechanism 432 may include fins, apertures, and/or other features that cause the rotary boom 428 to rotate when water passes through the rotation mechanism 432. Water may be discharged out of the nozzles 208 located on the rotary boom 428. The nozzles 208 may be spaced along the rotary boom 428 such that each nozzle sprays water on a different area (or ring during rotation) below the base. Thus, the distance from each nozzle to the point of rotation of the rotary boom 428 may be different, and thus provide full coverage of spray to an area below the base 120.

Figure 5:
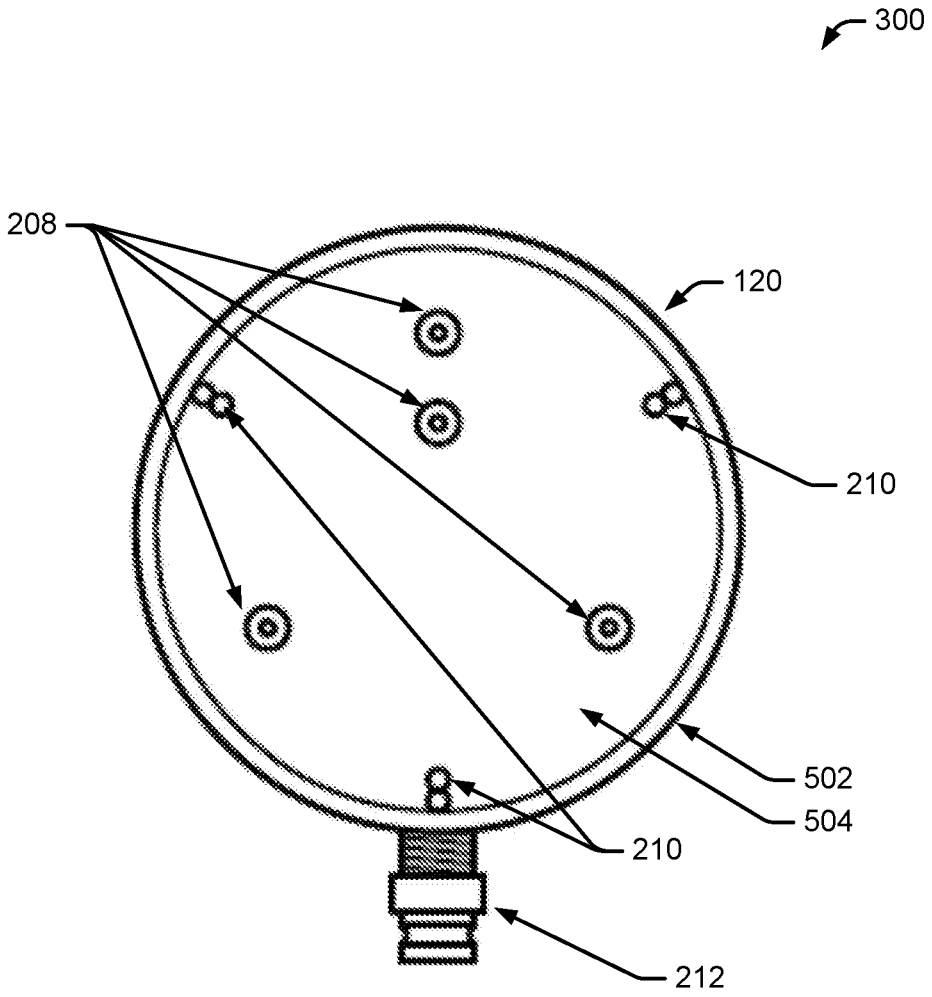
FIG. 5 is a bottom view of the support structure assembly shown in FIG. 3.

FIG. 5 is bottom view of the support structure assembly 300 shown in FIG. 3, which shows details of the base 120. The base 120 may be formed of a single piece, such as a metal, plastic, or composite to form a cap or concave shaped surface. The base 120 may be formed from multiple pieces such as a sidewall 502 coupled to a top surface 504 to create a cap. The top surface 504 may include apertures 506 to couple the nozzles 208. Although four nozzles 208 are shown, more or fewer nozzles 208 may be included in the base 120.

The guide features 210 may be coupled to the sidewall 502 and/or to a top surface 504. The guide features 210 may extend outward opposite the top surface 504 and parallel or nearly parallel to the sidewall 502. Although FIG. 5 shows three guide features 210 formed as pins, more or fewer guide features may be used. The guide features 210 may be formed using other shapes, such as a lip, which may be formed in the sidewall 502, for example. The sidewall 502 may include one or more aperture for the overflow outlet 212 to allow excess water to exit from the container 122 when water fills and overflows from the container 122 during a de-icing operation.

Figure 6:
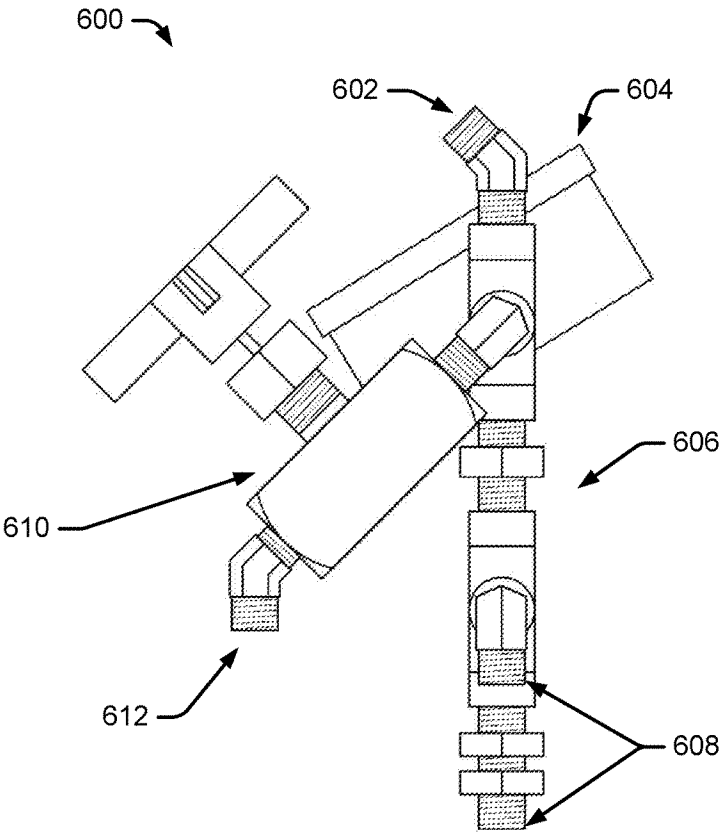
FIG. 6 is a side elevation view of an illustrative pressure regulator valve assembly.

FIG. 6 is a side elevation view of an illustrative pressure regulator valve assembly 600. The pressure regulator valve assembly 600 may include an inlet 602 that receives the pressurized water from the pressure washer 104 after the pressurized water travels through the hose 118 and possibly after the water flows through the trigger mechanism 202 when the trigger mechanism 202 is used to open a valve and allow the pressurized water to flow to the pressure regulator valve assembly 600.

The pressure regulator valve assembly 600 may include a pressure gauge 604 to provide a visual indication of the pressure in a regulated chamber 606 of the pressure regulator valve assembly 600. The water, having a regulated pressure, may exit regulated outlets 608 from the regulated chamber 606. The regulated outlets 608 may be in fluid communication with the regulated hoses 204, which may in turn be in fluid communication with the nozzles 208.

The pressure regulator valve assembly 600 may include a relief valve 610 to enable adjustment of the pressure in the regulated chamber 606. The relief valve 610 may reduce a pressure of the water by opening a valve that causes some water to flow through a discharge outlet 612, which may be in fluid communication with the discharge hose 206.

Figure 7:
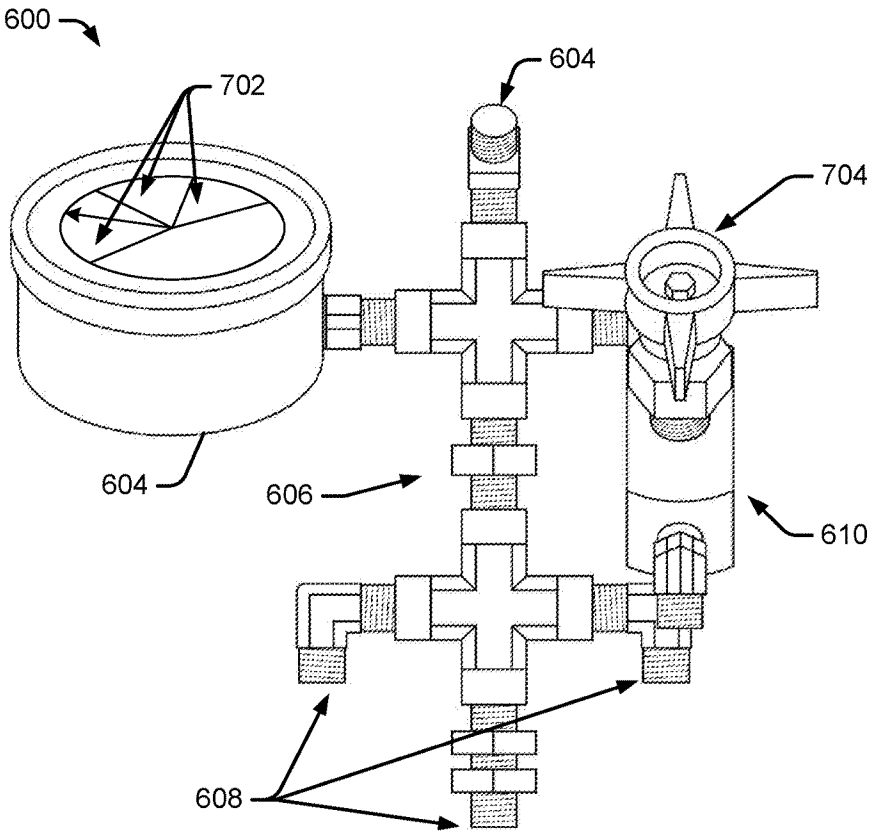
FIG. 7 is a left side elevation view of the illustrative pressure regulator valve assembly shown in FIG. 6.

FIG. 7 is a left side elevation view of the illustrative pressure regulator valve assembly 600 shown in FIG. 6. In some embodiments, the pressure gauge 604 may include indicators 702, such as codes, that correspond to measurements (or codes, etc.) from the depth gauge 412 (e.g., corresponding to the measurement 422, etc.), which may provide an indication to a user as to whether to adjust the pressure in the regulated chamber 606. The regulator valve assembly 600 may include an adjustment handle 704 to enable a user to manually adjust the pressure of the water in the regulated chamber.

During operation, as the depth of waste water in the container 122 increases and forms a pool of waste water, the spray from the water exiting the nozzles 208 may be prevented from penetrating through the pool of waste water toward ice located under the pool of waste water, and thereby may not be optimized for removing the ice at an optimal rate. Thus, a user may desire to increase the pressure via the relief valve 610 to cause the spray of water to penetrate deeper into the pool of waste water in the container 122. However, the user may likewise desire to avoid applying too much pressure, which may cause damage to components located within the container 122, such as a transformer, a light, wires, or other components that may be located within the container 122. Thus, regulation of the spray of the water may be monitored using the pressure gauge 604 and adjusted by the relief valve 610. The indicators 702 may guide the user's adjustment of the relief valve 610 accordingly.

Figure 8:
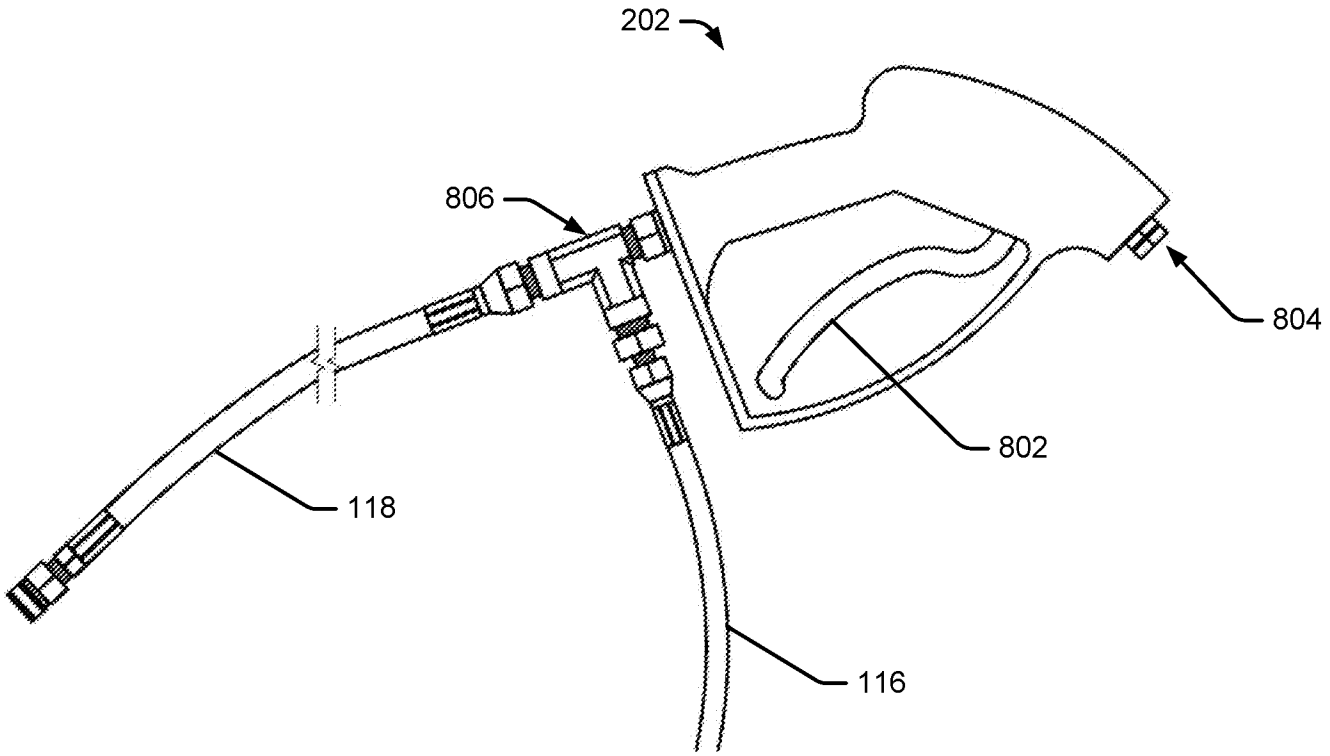
FIG. 8 is a side elevation view of an illustrative de-ice trigger mechanism.

FIG. 8 is a side elevation view of the illustrative de-ice trigger mechanism 202. The trigger mechanism 202 may regulate flow of the pressurized water supplied by the pressure washer 104 via the hose 118. The trigger mechanism 202 may be implemented as virtually any type of valve that allows a user to selectively open the valve and close the valve. The valve may be opened to intermediate states between fully opened and fully closed. In some embodiments, the valve may maintain a state (e.g., open, partially open, etc.) without interaction by a user. In various embodiments, a user may move a lever 802 (e.g., pull a trigger, etc.) to selectively open the valve and maintain the open state. From the trigger mechanism 202, the pressurized water flows through a trigger outlet 804 to the inlet 602 of the pressure regulator valve 124, via a coupler that provides fluid communication.

As shown in FIG. 8, a coupler 806 may couple the hose 118 to the hose 116 to provide fluid communication between the hoses. The coupler 806 may be a three way coupler that provides fluid communication that includes an inlet to receive the pressurized water from the pressure washer 104 and two outlets where one outlet is coupled to the hose 116 and the other outlet is coupled directly or indirectly to the trigger mechanism 202.

FIG. 9 is a side elevation view of the vacuum component 110 shown in FIG. 1. The vacuum component 110 may be used to remove waste water, waste fluid, and debris from the container 122 and/or other locations. The vacuum component 110 may receive the pressurized water from the pressure washer 104 via the hose 118. The vacuum component 110 includes a trigger mechanism 902 that regulates flow of the pressurized water supplied by the pressure washer 104 via the hoses 116 and 118. The trigger mechanism 902 may be implemented as virtually any type of valve that allows a user to open the valve and close the valve. The valve may be opened to intermediate states between fully opened and fully closed. In some embodiments, the valve may maintain a state (e.g., open, partially open, closed, etc.) without interaction by a user. In various embodiments, a user may move a lever 904 (e.g., pull a trigger, etc.) to selectively open the valve and maintain the open state.

From the trigger mechanism 902, the pressurized water flows through a pressure nozzle 906 that is configured to create a negative pressure in an inlet shaft 908. Thus, when pressurized water is permitted to pass through the trigger mechanism 902, the inlet shaft 908 experiences a negative pressure that causes suction at a suction inlet 912. The suction inlet 912 may then extract waste fluid, waste water, and debris from the container 122 and/or another location, which may be transported from the suction inlet 912 toward the pressure nozzle 906. Meanwhile, the pressurized water from the pressure washer 104 that is supplied via the hose 118 through the trigger mechanism 902 (when opening a corresponding valve) may flow toward the outlet shaft 910, join the waste fluid, waste water, and/or debris from the inlet shaft, and discharge out of the outlet shaft 910 via the outlet nozzle 126. Thus, the pressure nozzle 906 may create a vacuum effect to draw waste fluid, waste water, and/or debris into the suction inlet 912 and cause the waste fluid, waste water, and/or debris to be discharged out of the outlet nozzle 126. Additional details about the vacuum component 110 are provided with reference to FIGS. 10A, 10B, 11, and 12.

Figure 10B:
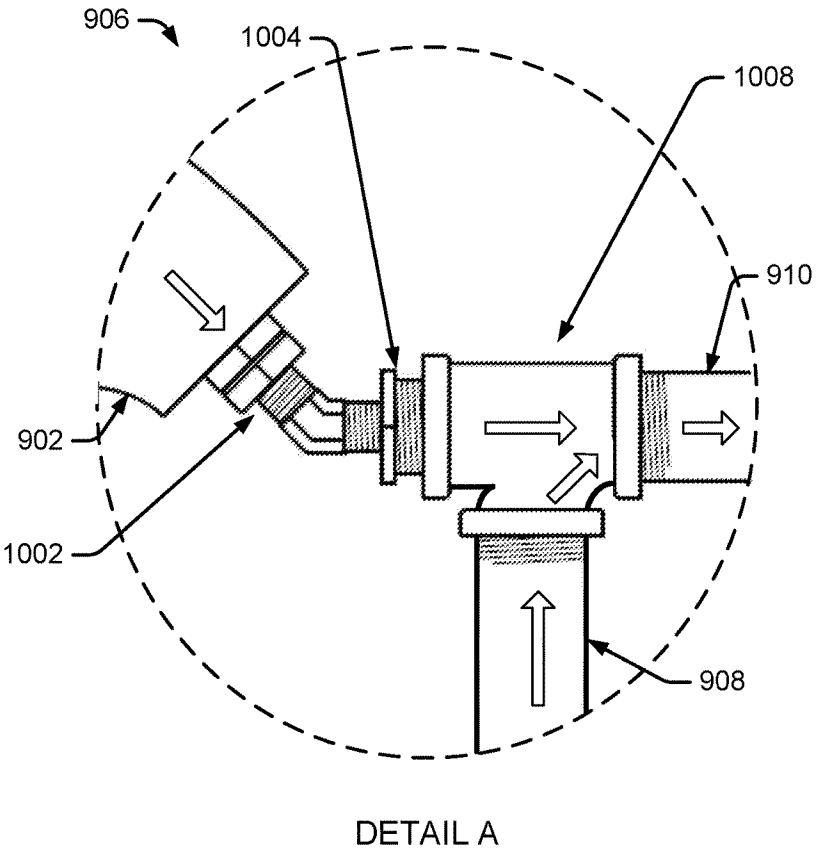
FIGS. 10A and 10B are side elevation views of illustrative pressure nozzles of the vacuum component shown in FIG. 9.
Figure 10A:
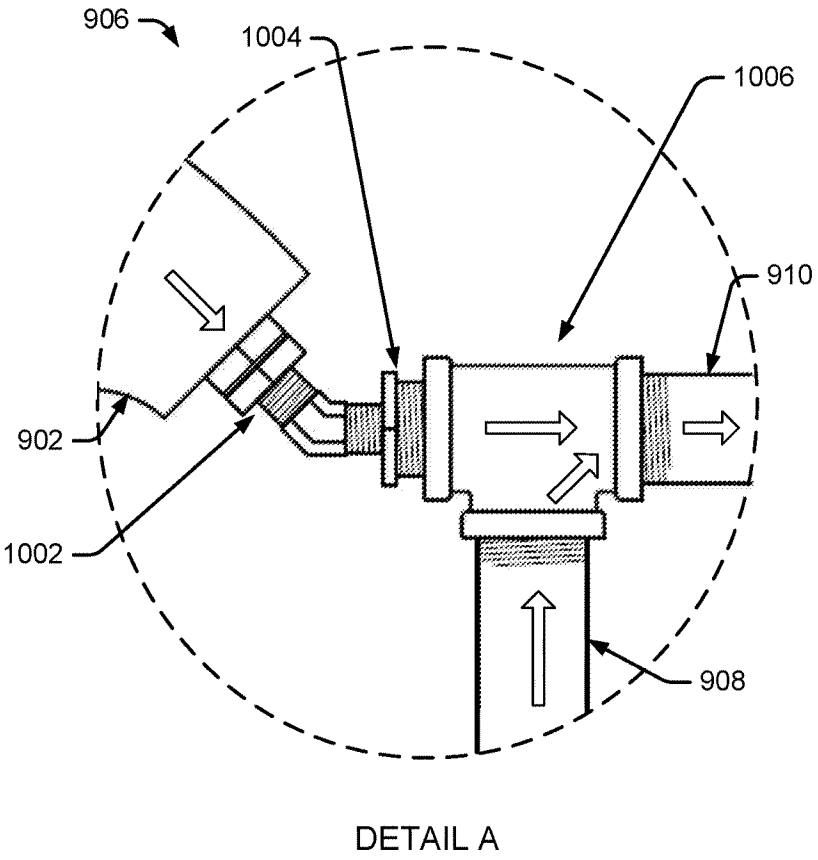

FIG. 10A is a side elevation view of the pressure nozzle 906 of Detail A of the vacuum component shown in FIG. 9. Arrows in Detail A are included to show the direction of flow of water, fluid, waste water, waste fluid, and/or debris. The pressurized water may flow through the trigger mechanism 902 and through a coupler 1002 that create fluid communication of the trigger mechanism 902 and the pressure nozzle 908. Next, the water may enter a high pressure nozzle 1004 to increase the pressure of the water, thus causing water to exit the high pressure nozzle 1004 with a greater pressure than the pressure of the water that enters the high pressure nozzle 1004. The high pressure nozzle 1004 may be a reducer that reduces a diameter of a pipe that the water flows toward. Next, the high pressure water may enter a coupling joint 1006 that couples the inlet shaft 908 and the outlet shaft 910. Through use of the high pressure nozzle 1004, the coupling joint 1006 may create a negative pressure in the inlet shaft 908. Thus, when pressurized water is permitted to pass through the trigger mechanism 902, the inlet shaft 908 experiences a negative pressure that causes suction at the suction inlet 912. The suction inlet 912 may then extract waste fluid, waste water, and debris from the container 122 and/or another location, which may be transported from the suction inlet 912 toward the pressure nozzle 906. Meanwhile, the pressurized water from the pressure washer 104 that is supplied via the hose 118 through the trigger mechanism 902 (when opening a corresponding valve) may flow toward the outlet shaft 910, join the waste fluid, waste water, and/or debris from the inlet shaft in the coupling joint 1006, and discharge out of the outlet shaft via the outlet nozzle 126. Thus, the high pressure nozzle 1004 may create a vacuum effect to draw waste fluid, waste water, and/or debris into the suction inlet 912 and cause the waste fluid, waste water, and/or debris to be discharged out of the outlet nozzle 126.

FIG. 10B is a side elevation view of the pressure nozzle 906 of Detail A of the vacuum component shown in FIG. 9, but with a coupling joint 1008. The coupling joint 1008 may include a sweeping corner, which may be implemented using a sanitary 'y' coupling joint or similar type of coupling joint. The coupling joint 1008 may reduce turbulent flow of waste fluid and waste water as it flows from the inlet shaft 908 to the output shaft 910.

Figure 11:
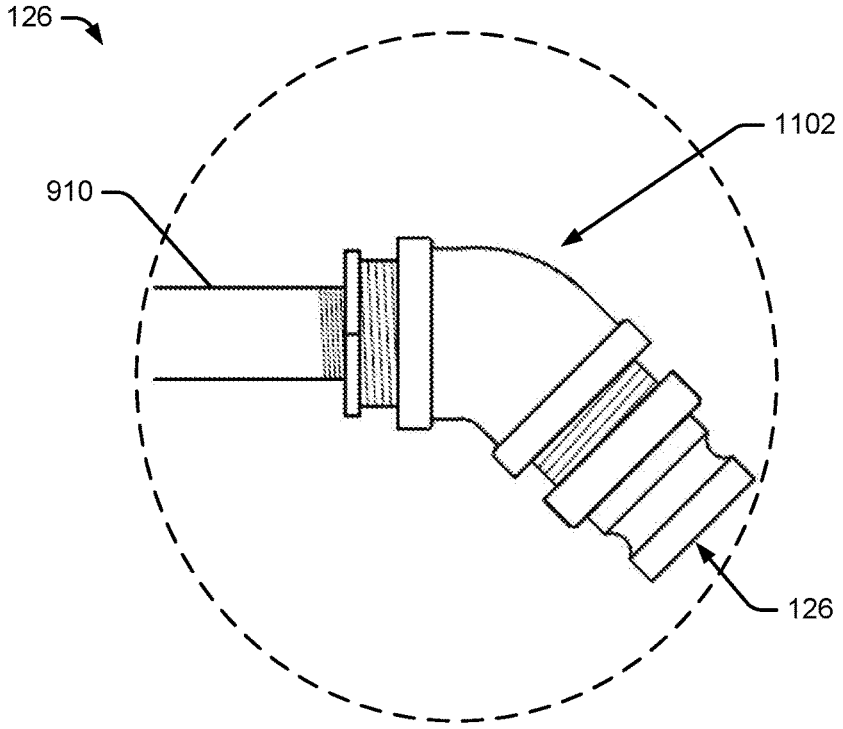
FIG. 11 is a side elevation view of an outlet nozzle of the vacuum component shown in FIG. 9.

FIG. 11 is a side elevation view of the outlet nozzle 126 of Detail B of the vacuum component shown in FIG. 9. In some embodiments, the outlet shaft 910 may include an angled coupler 1102 that couples to the outlet nozzle 126.

The angled coupler 1102 may deflect the combination of the water, the waste fluid, and the waste water just prior to discharge to slow the combined flow of water that discharges from the outlet nozzle 126. The outlet nozzle 126 may be configured to attach or couple to a hose, such as the hose that is coupled to the overflow outlet 212 and/or a hose that is connected to the fluid tank 106, which may allow reuse of the water. In some embodiments, the discharged water may be filtered or otherwise treated prior to a recycled use.

Figure 12:
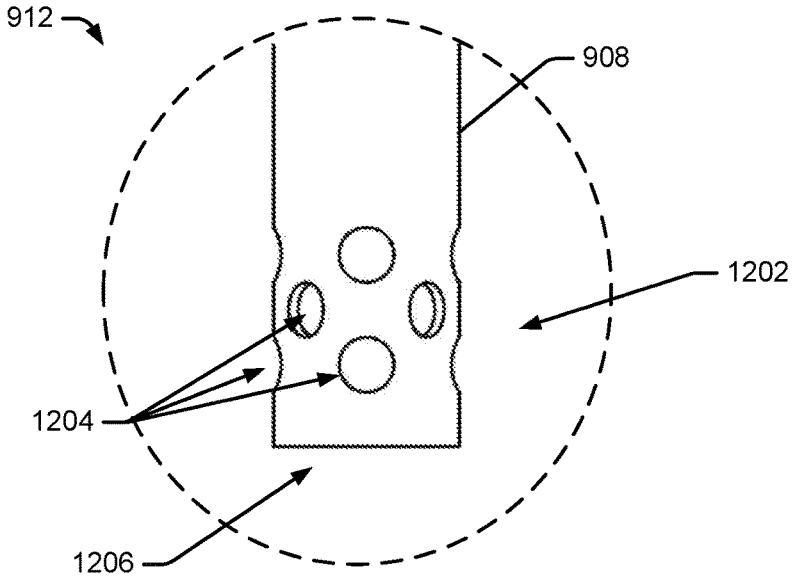
FIG. 12 is a side elevation view of a suction inlet of the vacuum component shown in FIG. 9.

FIG. 12 is a side elevation view of the suction inlet 912 of Detail C of the vacuum component shown in FIG. 9. The suction inlet 912 may include a debris filter 1202 formed by apertures 1204 in an end of the inlet shaft 908 that is opposite an end coupled to the joint coupler 1006. The debris filter 1202 may prevent passage of debris larger than the apertures 1204 into the inlet shaft. A bottom surface 1206 of the inlet shaft 908 may be capped. In various embodiments, the inlet shaft 908 may include an outer diameter that allows the inlet shaft 908 to be inserted into the holder 112, and thus allows the vacuum component 110 to join the de-ice component 108 for storage, transport, and/or for other reasons.

In some embodiments, the vacuum component 110 may be used while the inlet shaft 908 is inserted into the holder 112, and thus may allow removal of water, fluid, and/or debris before, during, or after a de-icing operation using the de-ice component 108. In some embodiments, the inlet shaft 908 may extend through the support shaft 114 and, possibly through the base 120 to access the waste fluid, waste water, and/or debris in the container 122 or other location. In various embodiments where use of the vacuum component 110 and the de-ice component 108 is used simultaneously, as made possible in some embodiments, the devices may use a same trigger mechanism to enable the simultaneous operation.

Illustrative Operation

Figure 13:
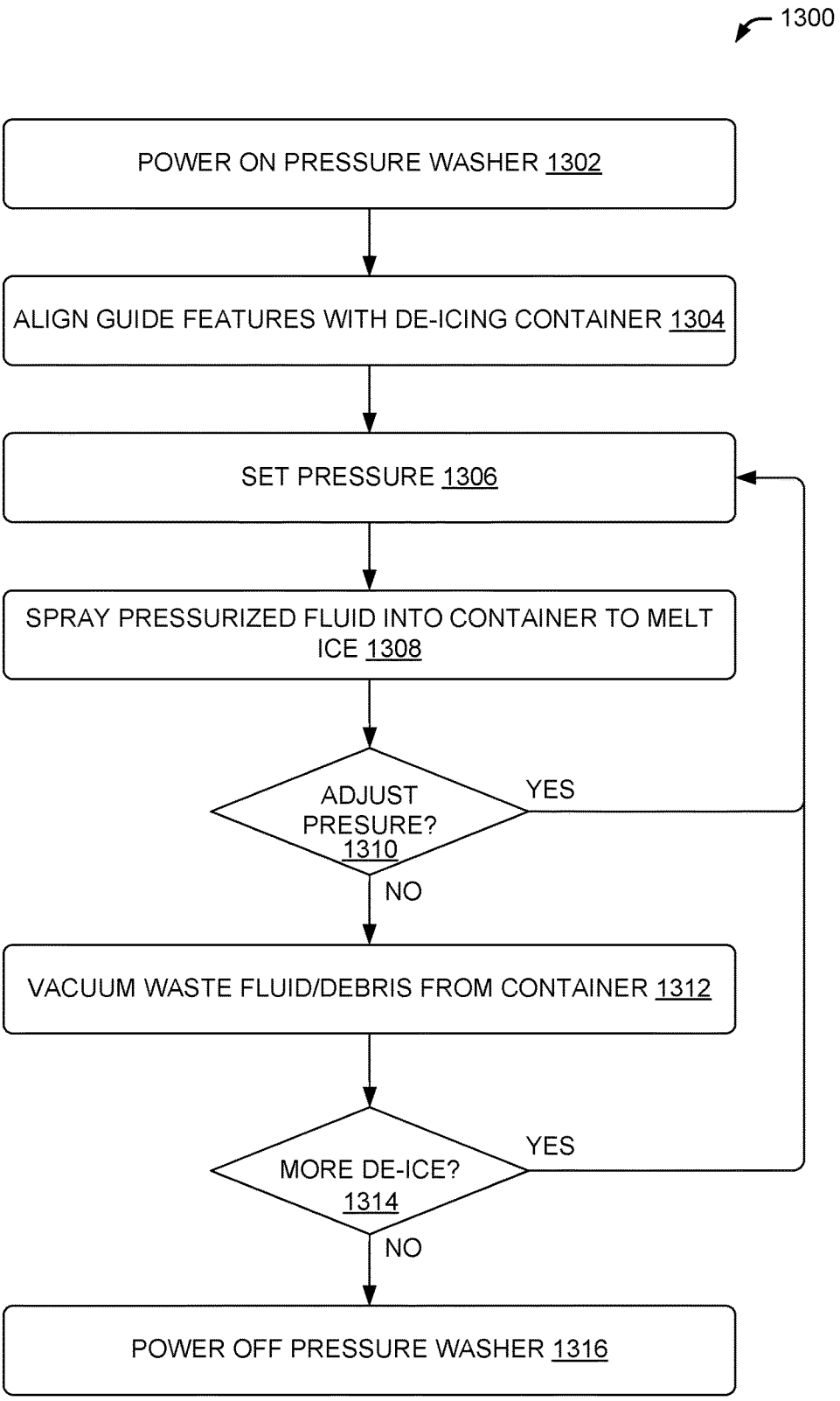
FIG. 13 is a flow diagram of an illustrative process to remove ice from a container.

FIG. 13 is a flow diagram of an illustrative process 1300 to remove ice from a container, such as the container 122. The process 1300 is illustrated as a collection of blocks in a logical flow graph, which represent a sequence of operations. The order in which the operations are described is not intended to be construed as a limitation, and any number of the described blocks can be combined in any order and/or in parallel to implement the process.

At 1302, the pressure washer 104 may be powered on to generate heated and pressurized fluid that is made available to the trigger mechanisms 202 and 902. The pressure washer 104 may receive fluid from the fluid tank 106.

At 1304, the guide features 210 may be aligned with or over the container 122 that includes the ice to be removed. The alignment guides may align the base 120 over the container 122 while allowing the de-ice component 108 to freely rotate around an axis parallel to the support shaft 114 during a de-icing operation to allow fluid discharging outward from the nozzles 208 to be directed to different areas of a surface within the container 122.

At 1306, the adjustment handle 704 may be used to adjust the pressure within the regulated chamber 606 to a desired pressure via the pressure regulator valve assembly 600. In some embodiments, indicators 702 may indicate the pressure based at least in part on a depth of waste fluid in the container 122. The pressure may be adjusted before or after activating the trigger mechanism 202 depending on the configuration of the pressure regulator valve 124 and the trigger mechanism 202.

At 1308, the trigger mechanism 202 may be activated to open a valve and release pressurized fluid through the valve. The pressurized fluid may flow out of nozzles 208 in the base 120 and toward ice in the container 122 to melt the ice. In some embodiments, the fluid may be disbursed by diffusers 410 on the nozzles, the rotary boom 428, and/or the rotary diffuser 414.

At 1310, the pressure may be adjusted using the adjustment handle 704 to adjust the pressure within the regulated chamber 606 to a desired pressure via the pressure regulator valve assembly 600. For example, when the depth of the waste fluid in the container 122 exceeds a threshold depth, the pressure may be increased to cause the fluid that is discharged from the nozzles 208 to penetrate deeper into the pool of waste fluid in the container 122 and more effectively melt ice in the container 122. When the pressure is to be adjusted (following the "yes" route from the decision operation 1310), then the process 1300 may continue at the operation 1306, as discussed above. When the pressure is not to be adjusted (following the "no" route from the decision operation 1310), then the process 1300 may continue at an operation 1312, as discussed below.

At 1312, the vacuum component 110 may be used to remove waste fluid, waste water, and/or debris from the container 122 or other location. For example, the user may remove the vacuum component 122 from the holder 112, insert the suction inlet 912 into the pool of waste fluid in the container 122, and then activate the trigger mechanism 902 to cause the waste fluid to be extracted/removed from the container and discharged via the outlet nozzle 126.

At 1314, the de-ice component 108 may be again aligned over the container 122 to continue a de-icing operation. When the de-icing operation is to continue (following the "yes" route from the decision operation 1314), then the process 1300 may continue at the operation 1306, as discussed above. When the de-icing operation is complete (following the "no" route from the decision operation 1314), then the process 1300 may continue at an operation 1316, as discussed below.

At 1316, the pressure washer 104 may be powered off. In some instances, the vacuum component 110 may be stowed in the holder 112 of the de-ice component 108.

Illustrative Parts

The following provides illustrative parts of some embodiments of the disclosure. However, other parts may be used to construct the apparatus described above. The next section entitled "Illustrative Assembly" discusses an illustrative assembly of at least some of these parts.

- 10 inch schedule 40 steel weld pipe cap
- 1 inch steel male half-coupler
- 1 inch Type F camlock connecter
- ¼ inch steel female coupler
- ⅜ inch round bar self-centering leg brace
- Hollow tube steel 1×1×1/16, 2 foot long, upright
- ⅜ inch round bar support brace
- ⅜ inch×2 inch washer mounting bracket
- Hollow tube steel 1×1×1/16, 4 inches long, handle
- 1⅛ inch×2 inch washer
- ¼ inch high pressure nozzle—3.5×0 degrees
- ¼ inch high pressure steel male pipe by No. 6 male JIC fitting
- #6 steel bulkhead nut
- ¼ inch high pressure steel female pipe-thread cross fitting
- ¼ inch high pressure steel male pipe by 45 degree male pipe fitting
- ¼ inch high pressure steel male pipe by 90 degree No. 6 male JIC fitting
- ¼ inch high pressure steel male pipe by 45 degree No. 6 male JIC fitting
- ¼ inch high pressure steel needle valve ¼ inch high pressure steel male pipe by 90 degree male pipe fitting
¼ inch lower mount 2½ inch diameter 0-3000 psi liquid filled pressure gauge
¼ inch high pressure steel male coupler
⅜ inch trigger gun
⅜ inch high pressure steel female pipe T-branch
⅜ inch male pipe by ¼ inch female pipe inline high pressure filter
⅜ inch, 10 foot long, high pressure hose with ¼ inch male swivel fitting and ⅜ inch male pipe fitting
⅜ inch brass female coupler
High pressure ¼ inch by ⅜ inch bushing
¼ inch, 6 foot long, high pressure hose with ¼ inch male swivel on both ends
¼ inch by ½ inch double-tap bushing
½ inch schedule 40 pipe T
½ inch, 3 foot long, threaded schedule 40 pipe
½ inch, 1 foot long, threaded schedule 40 pipe
½ inch by 1 inch pipe bushing
1 inch 45 degree schedule 40 threaded pipe elbow
1 inch water suction hose×8'-0"
1 inch Type C camlock connecter, Female×hose barb Illustrative Assembly The following provides illustrative parts and assembly of some embodiments of the disclosure. However, other parts may be used to construct the apparatus described above. In addition, other assemblies may be used to construct the apparatus described above.

In FIG. 5, the following parts may be used for the support structure assembly 300. A base may be comprised of a 10-inch schedule 40 steel weld pipe cap with a separate 10 inch neoprene seating gasket which the base sits upon when the apparatus is placed on the object to be thawed. 3½ inches from center of steel weld pipe cap, a circle is drawn. On this circle, every 60 degrees, a mark is made. Centered at 180 degrees and 1⅜" above the bottom lip of the pipe cap, a 1½ inch diameter horizontal hole is cut. Into this hole one half of a 1 inch steel female coupler is welded in place, and a 1 inch type F camlock is threaded into this coupler. At 0, 120 and 240 degrees, where marked, a ¾ inch hole is drilled into the cap at 90 degrees to horizontal. Into these holes, a ¼ inch steel female coupler is welded. A ¼ inch 3.5×0 degree high pressure carbon nozzle is threaded into the coupler on the underside of the weld cap.

In FIG. 4A, the following parts may be used for the support structure assembly 300. An upright square tube support/holder may be used. At center of cap, a 1×1×1/16 inch square steel tube is welded. The square tube is 24 inch in height with ¼ inch holes drilled at base to release any standing water. At 0 degrees, half way between the ¼ inch steel coupler and the edge of the upright tube, a ¾ inch hole is drilled into the cap at 90 degrees to horizontal. A ¼ inch steel female coupler is welded into this hole. A self-centering leg may be created as follows. At 60, 180, and 300 degrees, vertical legs are welded extending 1¼ inch past the bottom lip of the weld cap, spaced ⅜ inch from the inside face. The legs are made of ⅜ inch cold roll steel 4½ inches long. A ⅜ inch steel rod spacer is welded to the inside face of the weld cap bottom lip, and the leg is welded to the spacer and directly to the weld cap at the top.

Support rods for upright square tube may be used. At 3½ inches from center of weld cap, at 60, 180, and 300 degrees, where marked, ⅜ inch cold roll steel rods are welded in place. These support rods are 9½ inch in length. They are welded in place from the weld cap to the center support tube at an angle.

A handle is a 1×1×1/16 inch square steel tube, 4 inch in length welded to the upright center square tube support, with a 1⅛ by 2 inch washer welded on the end. The handle center is welded at a height of 18½ inch from top of pipe cap. On the back side of upright square steel tube, a ⅜ inch×2 inch steel plate washer is welded at a height of 18½ inch from top of pipe cap.

In FIG. 6, the following parts may be used for the pressure regulator valve assembly 600. A distribution block has a bulkhead fitting consisting of a ¼ inch male pipe by no. 6 male Joint Industry Council (JIC) fitting and bulkhead no. 6 nut. Threaded onto this, at the bottom port, is a ¼ inch high pressure female pipe-thread cross fitting. Threaded onto the bottom port of the male JIC of the bulkhead fitting, is a ¼ inch high pressure hose, 18½ inch in length, coupled with a female JIC no. 6 fitting at one end and a ¼ inch male pipe fitting at the other end to connect to the ¼ inch female coupling located in the base at 0 degrees. Threaded onto the left hand port of the high pressure female pipe-thread cross fitting is a ¼ inch male pipe by 90 degree JIC no. 6 fitting, with the male JIC facing downward. Threaded onto the male JIC fitting is a ¼ inch high pressure hose, 20½ inch in length, coupled with a female JIC no. 6 fitting at one end and a ¼ inch male pipe fitting at the other end to connect to the ¼ inch female coupling located in the base at 120 degrees. Threaded onto the right hand port of the high pressure female pipe-thread cross fitting is a ¼ inch male pipe by 90 degree JIC no. 6 fitting, with the male JIC facing downward. Threaded onto the male JIC fitting is a ¼ inch high pressure hose, 20½ inch in length, coupled with a female JIC no. 6 fitting at one end and a ¼ inch male pipe fitting at the other end to connect to the ¼ inch female coupling located in the based at 240 degrees. At the top port of this cross fitting is a ¼ inch high pressure steel male coupler that connects to the bottom of another ¼ inch high pressure steel female cross fitting. Threaded onto the left hand port of this cross fitting is a 2½ inch diameter liquid filled pressure gauge capable of displaying 0-3000 psi. Threaded onto the right hand port of this cross fitting is a ¼ inch high pressure steel male pipe by 90 degree male pipe fitting rotated down 45 degrees. Threaded to this fitting is high pressure steel needle valve. Threaded onto the other end of the needle valve is a ¼ inch high pressure steel male pipe by 45 degree No. 6 male JIC fitting. Threaded onto the male JIC fitting is a ⅜ inch high pressure hose, 18½ inches long, with a female JIC no. 6 to ⅜ inch Push-Lok fitting at one end and a ⅜ inch Push-Lok to ¼ inch male pipe fitting at the other end to connect to the ¼ inch female coupler without a spray nozzle located in the pipe cap at 0 degrees. The top port of the cross fitting is the water inlet, which is a male pipe by male pipe 45 degree fitting. These threads into the outlet of a high-pressure valve assembly (squeeze handle trigger gun).

In FIG. 8, the following parts may be used for the de-ice component 108. Connected to the inlet of the spray gun is a high-pressure steel T, the openings of which consist of a ⅜ inch male pipe by ⅜ inch female pipe (which is the side opening of the steel T and threads into the vacuum gun supply hose, by ⅜ inch female pipe (which is the lower opening of the T and threads into the water supply line). The lower inlet port of the steel T connects to a ¼ inch male pipe by ¼ inch female pipe inline high pressure filter. Attached to this is the water supply line which is a ⅜ inch high pressure hose 10 feet in length that has a ¼ inch male pipe swivel fitting on one end and a ⅜ inch male pipe fitting on the other. This ⅜ inch male pipe fitting connects to a brass ⅜ inch female coupler. The side port of the high pressure steel T has a high pressure ¼ inch by ⅜ inch bushing.

Attached to this bushing is a ¼ inch high pressure hose 6 feet in length with ¼ inch male pipe swivels on each end of the hose. This hose goes from the side port of the steel T to the high-pressure vacuum gun at the other end.

In FIG. 9, the following parts may be used for the vacuum component 110. From the 6-ft high pressure hose with the ¼ inch male pipe swivel at the end, a ⅜ inch by ¼ inch bushing attaches the hose to the high pressure trigger gun. Attached to the outlet of the high pressure trigger gun is a 45 degree ¼ inch male pipe by ¼ inch male pipe steel elbow. This 45 degree steel elbow threads into the hex end of a ¼ inch by ½ inch steel double-tap bushing. On the threaded end of the double tap bushing is a zero degree high pressure carbon steel nozzle. This all gets threaded into a ½ inch standard schedule 40 metal pipe T. The vacuum pickup tube is a ½ inch by 36 inch steel pipe which is threaded into the T. A 1/16 inch plate with a ¼ inch hole is welded into the other end of the vacuum tube. Additionally six more ¼ inch holes are drilled into this end of the pickup tube ¼ inch from the bottom and separated vertically by ¼ inch. The vacuum discharge tube is a ½ inch by 12 inch steel pipe, threaded at each end. One end is attached to the T. The other end of this ½ inch steel pipe is threaded into a ½ inch by 1 inch pipe bushing. An inch standard schedule 40 metal pipe elbow (deflection elbow) is threaded onto this bushing, and a 1 inch Type F camlock is screwed into the open end of the elbow. An 8 foot 1" diameter water suction hose fitted with a 1 inch Type C camlock can be attached either to the vacuum discharge male camlock connector or the male camlock connector welded to the side of the pipe cap.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A method of removing ice from a container, the method comprising:

aligning guide features of a base of a de-ice component with an orifice of the container that includes the ice to be removed;

selecting a pressure of fluid to be discharged through nozzles in the base and toward the ice in the container;

activating a first trigger valve to selectively cause pressurized and heated fluid to be discharged through the base to melt the ice;

rotating the base relative to the orifice while the guide features engage the container to vary a direction of dispersion of the fluid discharged into the container; and activating a second trigger valve of a vacuum component to selectively cause the pressurized and heated fluid to be discharged through a high pressure valve to create a vacuum in an inlet shaft, the inlet shaft configured to remove waste fluid from the container that includes melted ice and the fluid.

2. The method as recited in claim 1, further comprising adjusting the pressure of the fluid to be discharged through the nozzles after the activating the first trigger valve to cause the pressurized and heated fluid to be discharged through the base to melt the ice.

3. The method as recited in claim 1, further comprising removing the vacuum component from a holder of the de-ice component prior to the activating the second trigger valve.

4. The method as recited in claim 1, further comprising powering on a pressure washer to generate the pressurized and heated fluid.

5. The method as recited in claim 1, further comprising:

increasing the pressure of the fluid to be discharged through the nozzles; and further activating the first trigger valve to selectively cause higher pressurized fluid to be discharged through the base to melt the ice.

6. The method as recited in claim 1, further comprising inserting at least a portion of the inlet shaft of the vacuum component into the waste fluid in the container.

7. The method as recited in claim 1, further comprising powering on the de-ice component to generate pressure of the fluid, heat the fluid, or both.

8. A method comprising:

aligning a base of a de-ice component with an aperture of a container that includes ice to be removed, the base including nozzles to selectively release fluid;

selecting a first pressure of the fluid to be discharged through the nozzles toward ice in the container;

activating a first trigger valve to cause the fluid to be discharged through the base to melt the ice; and activating a second trigger valve to cause the fluid to be discharged through a high pressure valve to create a vacuum in an inlet shaft, the inlet shaft to remove waste fluid from the container that includes melted ice and the fluid.

9. The method as recited in claim 8, further comprising heating the fluid prior to dispersing the fluid through the nozzles.

10. The method as recited in claim 8, further comprising rotating the base relative to the container while the base engages the container to vary a direction of dispersion of the fluid discharged into the container.

11. The method as recited in claim 8, wherein the second trigger valve is coupled to a vacuum component.

12. The method as recited in claim 8, wherein the aligning further includes aligning guide features of the base with the aperture of the container.

13. The method as recited in claim 8, further comprising:

selecting a second pressure of the fluid to be discharged through the nozzles toward ice in the container; and further activating the first trigger valve to cause the fluid at the second pressure to be discharged through the base to melt the ice.

14. The method as recited in claim 8, further comprising powering on the de-ice component to generate the first pressure of the fluid.

15. The method as recited in claim 8, further comprising inserting at least a portion of the inlet shaft of a vacuum component into the waste fluid in the container prior to activating the second trigger valve.

16. A method comprising:

aligning guide features of a base of a de-ice component with an orifice of a container that includes ice to be removed from the container;

selecting a pressure of fluid to be discharged through nozzles in the base and toward the ice in the container;

activating a first trigger valve to selectively cause the fluid to be discharged through the base to melt the ice; and rotating the base relative to the orifice while the guide features engage the container to vary a direction of dispersion of the fluid discharged into the container.

17. The method as recited in claim 16, wherein the rotating the base occurs at least partly while the first trigger valve causes the fluid to be discharged through the base.

18. The method as recited in claim 16, further comprising heating the fluid prior to activating the first trigger valve.

19. The method as recited in claim 16, further comprising activating a second trigger valve to activate a vacuum to remove waste fluid from the container that includes melted ice and the fluid.

20. The method as recited in claim 16, further comprising activating a pressure washer to pressurize the fluid.

* * * * *